United States Patent [19]

Gasser

[11] Patent Number: 4,810,550

[45] Date of Patent: Mar. 7, 1989

[54] PROTECTIVE TABLE EDGE

[75] Inventor: Mark E. Gasser, Youngstown, Ohio

[73] Assignee: The Gasser Chair Company, Youngstown, Ohio

[21] Appl. No.: 108,051

[22] Filed: Oct. 14, 1987

[51] Int. Cl.[4] ..... B32B 3/06

[52] U.S. Cl. ..... 428/100; 428/120; 428/192; 428/188; 428/217; 248/345.1; 52/717.1

[58] Field of Search ..... 428/188, 192, 120, 100, 428/217; 248/345.1; 52/716, 717, 718

[56] References Cited

U.S. PATENT DOCUMENTS

| | | | |
|---|---|---|---|
| 3,777,438 | 12/1973 | Brown | 52/718.1 X |
| 3,897,967 | 8/1975 | Barenyi | 52/718.1 |
| 4,246,303 | 1/1981 | Townsend | 428/188 X |
| 4,368,225 | 1/1983 | Nussbaum | 52/716 X |
| 4,370,373 | 1/1983 | Janicz | 428/151 |

*Primary Examiner*—Alexander S. Thomas
*Attorney, Agent, or Firm*—Harpman & Harpman

[57] ABSTRACT

Furniture construction such as tables designed for commercial use such as in restaurants, are generally provided with an edge construction capable of absorbing normal impact forces so as to avoid permanent dents or cracks in normal usage. It is also desirable to provide an attractive appearing furniture edge that has a desirable feel and cushioning. A protective table edge that meets these several requirements and others comprises an elongated semi-solid hollow vinyl extrusion, a first portion of which carries a barbed flange perpendicularly thereto and a second portion of which is bowed outwardly with respect to the surface of the first portion, the portions may be and preferably are formed of different polyvinyl chloride material having different degrees of rigidity and of equal importance different colors so that the protective table edge installed upon a table or other furniture may incorporate a constrasting color accent stripe. The barbed flange frictionally engages a slot formed in the table edge or other piece of furniture to which the protective table edge is applied.

6 Claims, 1 Drawing Sheet

PROTECTIVE TABLE EDGE

BACKGROUND OF THE INVENTION

1. Technical Field

This invention relates to the construction of furniture and in particular it relates to a novel edging attachable to the rim of a table.

2. Description of the Prior Art

The use of edging for furniture pieces is quite commonplace especially if the top of the furniture piece is made from a composite material or a layered laminate panel material. The edging serves several purposes. First the edging hides the sides of the panel material providing an aesthetically pleasing edge to the panel and the furniture piece, second the edging protects the sides of the panel from getting marred or chipped through normal use, and third the edging serves as a device to hold the panel together so that the panel does not separate due to humidity and moisture or age.

Prior to the present invention most furniture edging was made of relatively rigid material as for example the slightly resilient rubber wear piece or bumper illustrated in U.S. Pat. No. 1,936,113 and U.S. Pat. No. 2,196,933. A rubber scuff plate used as a furniture edging in U.S. Pat. No. 2,193,719 discloses a rubber section of limited resiliency so as to be able to be selfretaining on longitudinally spaced fasteners, the heads of which are engaged thereby. A rigid aluminum extrusion forming an edging arranged to be covered with a laminated covering material or the like is illustrated in U.S. Pat. No. 2,980,477 and a resilient edging formed of polyurethane foam having a surface skin is molded around a core of relatively hard material having a barbed flange perpendicular of one surface thereof may be seen in U.S. Pat. No. 4,370,373. A resilient stretchable edging in the form of a closed loop is disclosed in U.S. Pat. No. 4,503,780 where it acts to form an edge on a table or the like and at the same time hold two panels of the table in assembled relation.

The present invention forms a protective table edge as a unitary extruded hollow shape, a first portion of which is relatively more rigid than a second portion, the first portion having a perpendicular barbed flange by which the protective table edge may be affixed to a table top or the edge of another panel or the like. The second portion is of a more resilient material extruded simultaneously with the first portion and bowed outwardly from the surface of the first portion opposite the perpendicular barbed flange, the two portions preferably being formed of materials of different durometers and different colors.

SUMMARY OF THE INVENTION

A protective table edge comprising a dual durometer construction which provides for multiple color combinations of the protective edge and enables the outwardly bowed portion of the protective table edge to be more resilient than the portion thereof having the perpendicular barbed flange mounting means. The hollow formation of the protective table edge provides a continuous air chamber in the edge which substantially improves the cushion effect thereof and its ability to provide a soft contact point when tables equipped with the edge are moved together or chairs or other objects forcibly engaged thereagainst. The outwardly bowed portion of the table edge may be easily formed as part of the integral extrusion with any desired outer configuration including a continuous bowed arc, several interconnecting flat planes, or provided with longitudinally extending circumferentially spaced ribs or similar decorative accents.

DESCRIPTION OF THE PREFERRED EMBODIMENT

Figure 1:
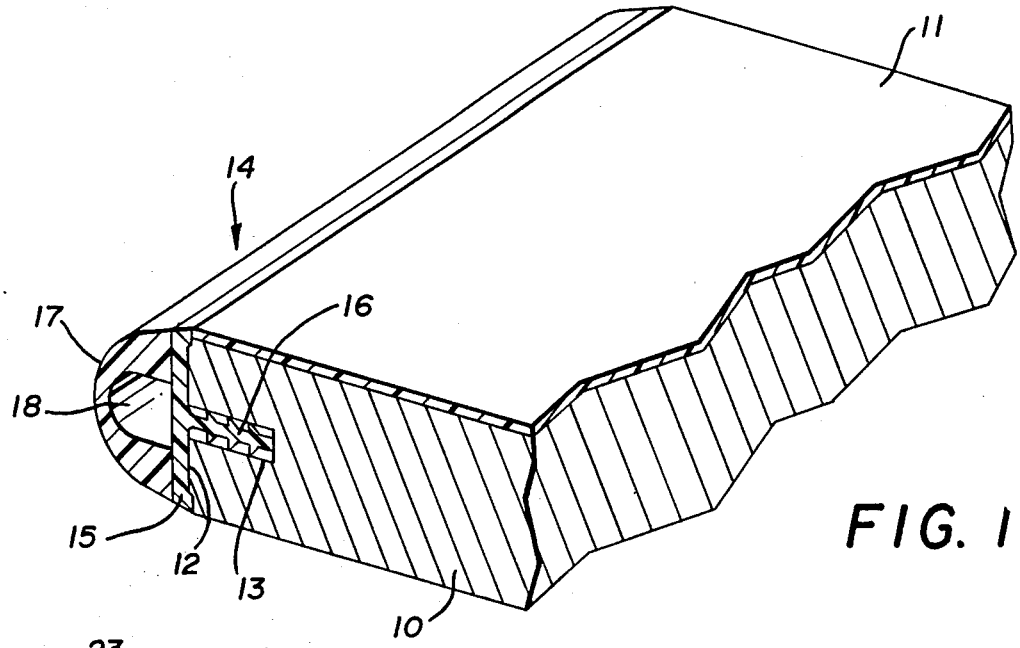
FIG. 1 is a perspective elevation of a portion of a table top with the protective table edge affixed thereto with parts in cross section and parts broken away.

By referring to FIG. 1 of the drawings, it will be seen that a portion of a table top 10 or similar piece of furniture has been disclosed and that it is provided with a surface material 11 for ornamental and wear purposes. An outer edge 12 of the table top 10 is provided with an inwardly extending slot 13 to facilitate the attachment of a protective table edging generally indicated at 14 and consisting of a first portion 15 having a perpendicular barbed flange 16 on one side thereof arranged for frictional engagement in the slot 13 in the edge 12 of the table top 10. An outwardly bowed second portion 17 of the protective table edging is integrally formed with the first portion 15 and bows outwardly in a modified C-shape from the surface of the first portion 15 opposite the surface from which the barbed flange 16 extends.

As disclosed in FIG. 1 of the drawings, the modified C-shape of the second portion 17 of the protective table edge defines a longitudinal chamber 18 and which in effect forms a pneumatic cushion as the second portion 17 of the protective table edge 14 is relatively more resilient than the first portion 15. For example the polyvinyl chloride material forming the second portion 17 may be of a 70–80 durometer while the first portion 15 may be polyvinyl chloride that is semi-rigid. Of equal importance is the fact that the polyvinyl chloride material of which the second portion 17 of the protective table edge 14 is made may be of one color while the first portion 15 of the protective table edge 14 may be of a contrasting different color.

Figure 5:
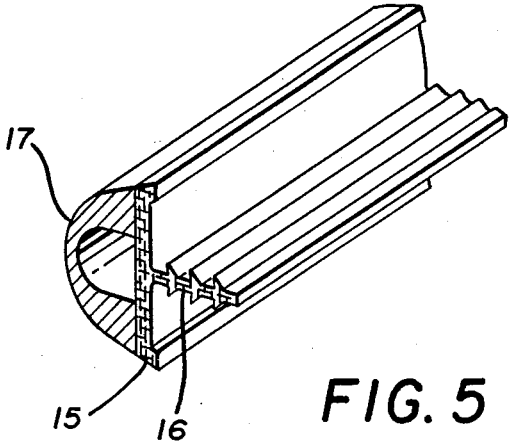
FIG. 5 is a perspective elevation of a portion of the protective table edge seen in FIG. 1 and wherein shading indicating the colors brown and gold are applied to indicate the different color possibilities of the different portions of the protective table edge.

As illustrated in FIG. 5 of the drawings, the second portion 17 has been color shaded for the color tan and the first portion 15 and the barbed flange 16 have been color shaded for the color gold. When this particular color combination in the protective table edging is applied to a table top as in FIG. 1 of the drawings wherein the surface material 11 is a tan color matching the tan color of the second portion 17 of the protective table edge, the gold color of the uppermost edge portion of the first portion 15 of the protective table edging appears as a contrasting color stripe and as it is more rigid than the second portion 17 it will retain its position on the edge of the table top 10 in abutting sealing relation to the surface material 11 thereon.

Those skilled in the art will observe that many different densities and/or degrees of resilience may be incorporated in the protective edging disclosed herein as well as many different colors and contrasting colors as desired.

Figure 2:
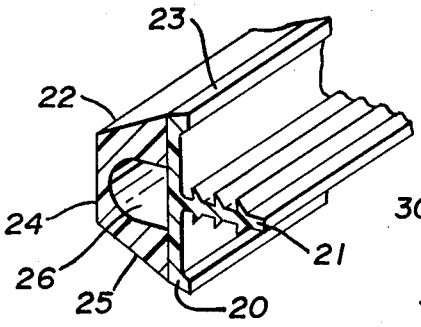
FIG. 2 is a perspective view of an end portion of a modified shape of the protective table edge.

Modifications of the invention will occur to those skilled in the art and one such modification is illustrated in Figure 2 of the drawings wherein a first portion 20 of a protective table edging is provided with a perpendicular barbed flange 21 on one side and has an integrally molded outwardly bowed second section 22 which has three inter-engaging flat planes 23, 24 and 25 respectively forming its outer surface and an inner hollow configuration defining a pneumatic chamber 26.

Figure 3:
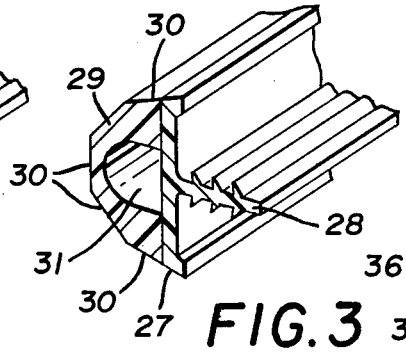
FIG. 3 is a perspective view of an end portion of a further modified shape of the protective table edge.

A further modification is illustrated in FIG. 3 of the drawings wherein a first portion 27 of a protective table edging may be seen which has a perpendicular barbed flange 28 on one side thereof and an outwardly bowed second portion 29 on the other side thereof, the second portion 29 having a plurality of inter-engaging flat planes 30 defining its outer surface and positioned around a longitudinal cavity 31 which forms a pneumatic chamber.

Figure 4:
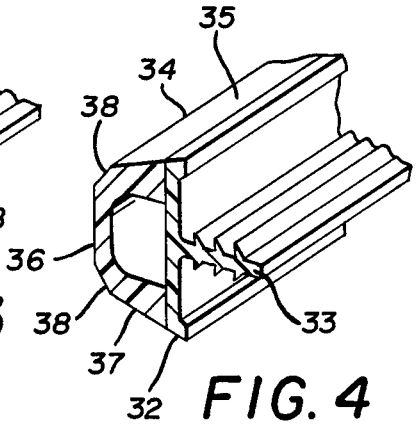
FIG. 4 is a perspective view of an end portion of a further modification of the protective table edge.

A further modification may be seen in FIG. 4 of the drawings wherein a first portion 32 of a protective table edging is provided with a barbed flange 33 on one side and the other side comprises a generally rectangular shape in cross section indicated by the numeral 34 and having an upper surface 35, an outer vertical surface 36 and a lower horizontal surface 37 with angular connecting planes 38 joining the same to one another.

Each of the modified forms of the protective table edge disclosed in FIGS. 2, 3 and 4 of the drawings are integral extrusions preferably of polyvinyl chloride material and each has its two portions so identified hereinbefore formed of vinyl material of different degrees of resiliency and different colors.

It will thus be seen that a protective table edging comprising a dual durometer hollow vinyl extrusion has been disclosed which has unique cushioning properties when affixed to a table edge or to any similar surface of any piece of furniture as will occur to those skilled in the art. The protective table edging has substantially improved cushioning and shock absorbing ability due to its longitudinally extending cavity which in effect forms a pneumatic air cushion as air confined therein must be compressed when the more resilient portion of the protective table edge is pushed inwardly.

The resultant dual cushioning means, the air cushion and the resilience of the polyvinyl chloride material insure against damage of the protective table edge and the different colors of the respective integral parts thereof enable it to form an attractive edge on a table or other piece of furniture.

Having thus described my invention what I claim is:

1. An extruded dual durometer integral elongated protective edge member for a piece of furniture comprising a first portion of semi-rigid material disposed in a plane, said first portion having first and second substantially flat surfaces, said first flat surface for contacting an outer edge of said furniture, said first portion further having a barbed flange disposed perpendicularly to and extending from said first flat surface along the length thereof and a cross sectionally C-shaped body of material, more flexible than the material of said first portion, integrally formed with and disposed on said second flat surface of said first portion in oppositely disposed relation to said barbed flange along with the length thereof, said C-shaped body and said second flat surface defining a hollow chamber, said C-shaped body being precluded from contacting said furniture by said first portion.

2. The protective edge member as recited in claim 1 and wherein said first portion is made of semi-rigid polyvinyl chloride material and said C-shaped body member is made of relatively flexible polyvinyl chloride material.

3. The protective edge member as recited in claim 1 and wherein said first portion is formed of semi-rigid material having a first color and said C-shaped body is formed of material having a second color.

4. The protective edge member as recited in claim 1 and wherein said first portion is disposed in a vertical plane, said barbed flange is disposed in a horizontal plane substantially midway between the upper and lower edges of said first portion and on said first flat surface and wherein said C-shaped body of relatively flexible material extends outwardly from said second flat surface.

5. The protective edge member as recited in claim 1 and wherein said C-shaped body of relatively flexible material has an outermost surface forming several longitudinally extending interconnected flat planes.

6. An extruded one-piece protective table edging consisting of an elongated member of semi-rigid material disposed in a vertical plane, said elongated member having first and second substantially flat surfaces, said first flat surface for contacting an outer edge of said table, said first surface having a barbed flange extending longitudinally thereof and extending perpendicularly therefrom and an integral substantially C-shaped body member of material, more flexible than the material of said elongated member, on said second flat surface of said elongated member in oppositely disposed relation to said barbed flange, the area defined by said substantially C-shaped member and said elongated member defining a flexible air cushion, said C-shaped member being precluded from contacting said table by said elongated member.

* * * * *